US007082954B1

(12) United States Patent
Flanery et al.

(10) Patent No.: US 7,082,954 B1
(45) Date of Patent: Aug. 1, 2006

(54) TENT STAKE

(76) Inventors: Roger Flanery, 5759 Cedar Bay Dr., Millington, TN (US) 38053; Irene Flanery, 5759 Cedar Bay Dr., Millington, TN (US) 38053

( * ) Notice: Subject to any disclaimer, the term of this patent is extended or adjusted under 35 U.S.C. 154(b) by 69 days.

(21) Appl. No.: 10/897,862

(22) Filed: Jul. 23, 2004

(51) Int. Cl.
*E04H 15/62* (2006.01)

(52) U.S. Cl. ..... 135/118; 135/120.4; 248/508; 248/156; 52/155; 5/417

(58) Field of Classification Search ..... 135/118, 135/120.4, 116; 52/155–156, 164, 23; 119/786, 119/787; 248/156, 508; 5/417–420; 24/72.5
See application file for complete search history.

(56) References Cited

U.S. PATENT DOCUMENTS 1,011,729 A * 12/1911 Bradford ..... 119/786
1,146,128 A * 7/1915 Brune ..... 135/118
2,809,006 A * 10/1957 Jansey ..... 248/508
3,432,878 A * 3/1969 Hupfer ..... 16/32
3,788,336 A 1/1974 Steffes
3,823,430 A 7/1974 Welsh, II et al.
4,198,719 A 4/1980 Feldpausch
4,454,792 A 6/1984 Burris
4,699,165 A * 10/1987 Barzana ..... 135/118
4,870,781 A * 10/1989 Jones ..... 47/43
4,905,718 A 3/1990 Vandiver
4,936,194 A 6/1990 Horowitz
4,953,576 A * 9/1990 Connelly ..... 135/118
5,161,487 A * 11/1992 Miller ..... 119/786
5,564,232 A 10/1996 Callaway
D377,076 S 12/1996 Adams
5,732,659 A * 3/1998 Wiggins ..... 119/787
5,971,668 A * 10/1999 Miller ..... 405/259.1
6,402,115 B1 * 6/2002 Groff et al. ..... 248/508
2002/0066240 A1 6/2002 Chizmas

* cited by examiner

*Primary Examiner*—Winnie Yip
(74) *Attorney, Agent, or Firm*—Lawrence J. Gibney, Jr.

(57) ABSTRACT

A tent stake with a handle attached by a swivel, a flat area for pounding the stake into the ground, and multiple holes drilled into the shaft, so that ropes or tie down strings may be secured into the ground when a tent is secured.

4 Claims, 3 Drawing Sheets

TENT STAKE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This allows a tent to be staked easily and securely but further enables the stake to be removed without any damage to the tent.

B. Prior Art

While many devices achieve similar effects, the present invention provides a unique, novel, and improved way for using a tent. The various tent stake patents, such as Vandiver, U.S. Pat. No. 4,905,718, and Steffes, U.S. Pat. No. 3,788,336, do not produce the array of functions which the present invention produces. While the Horowitz patent, U.S. Pat. No. 4,936,194 is somewhat similar, its design is still different and it provides a different function than the recent invention.

BRIEF SUMMARY OF THE INVENTION

This is a device, which allows the user to secure a tent to the ground. It also has a mechanism for insertion of a tie down string which secures various parts of a tent such as a cover.

The device itself has a swivel handle on the top and a flat surface for pounding the stake into the ground. The flat surface is large enough to provide a surface for the mallet or hammer.

It is anticipated that this device may be constructed from a variety of materials but the materials must be strong enough to withstand the force of a hammer or mallet on the top and also must not break off in rough terrain. Hard plastic or metal are possible materials for construction.

Below the top portion of this device is a handle to easily pull the stake out of the ground, thereby reducing potential damage to the stake as well as potential damage to the tent and in particular ripping the tent fabric, which is used to stake the tent through the use of a loop in the tent fabric. Damage to the loop, which secures the tent could render the tent unusable.

DETAILED DESCRIPTION OF THE EMBODIMENTS

Figure 1:
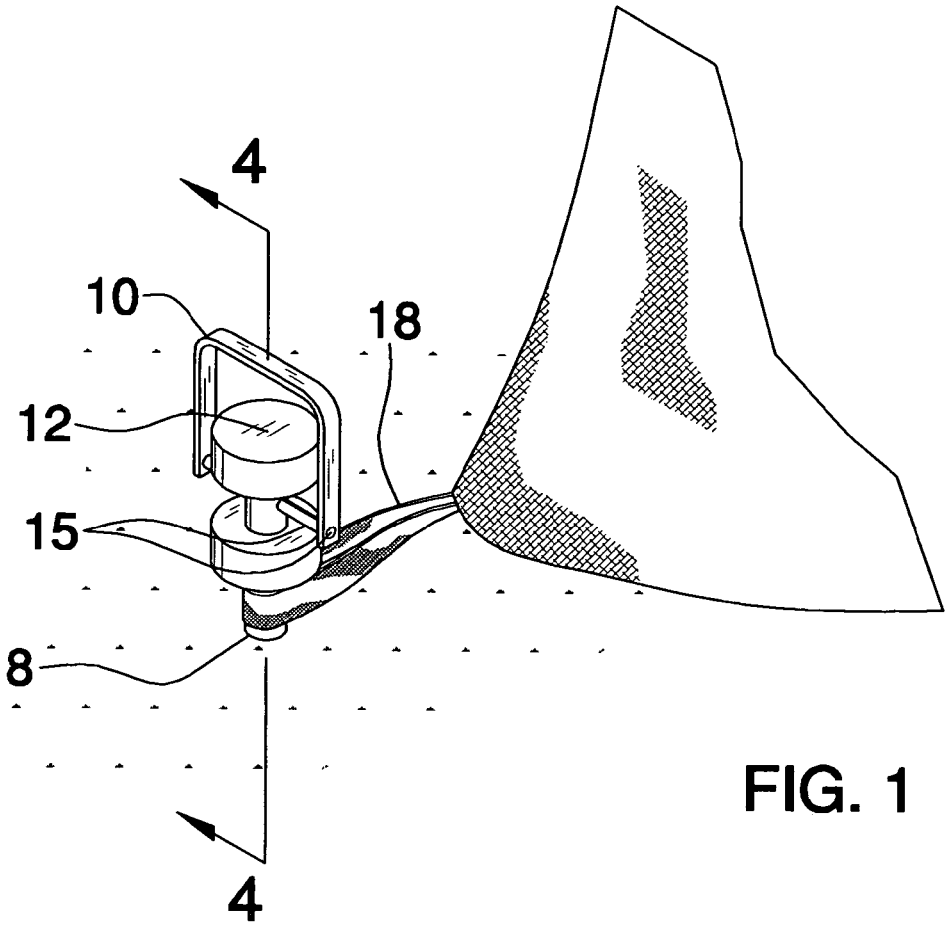
FIG. 1 is a perspective view of the device securing the tent hold down strap.
Figure 2:
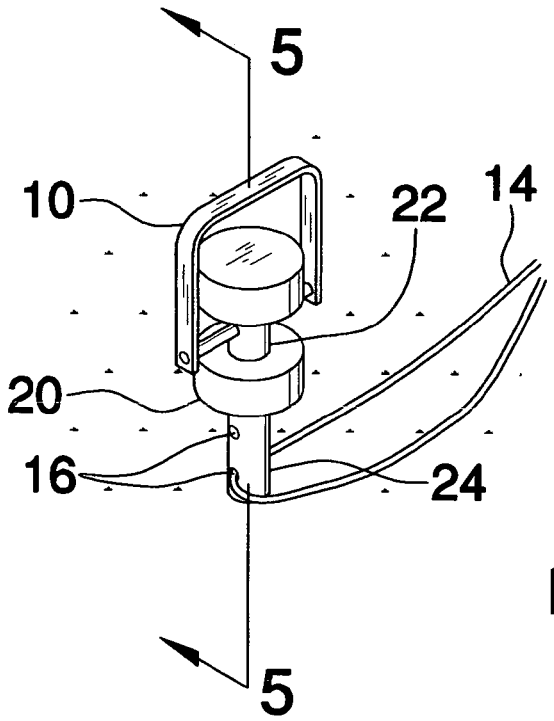
FIG. 2 is a perspective view of the device in use it to secure a tie down string.
Figure 3:
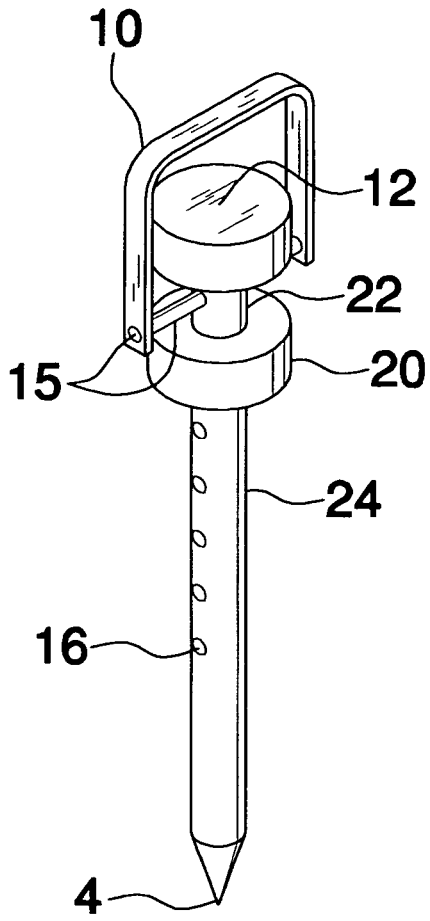
FIG. 3 is a perspective view of the device with all parts shown.
Figure 4:
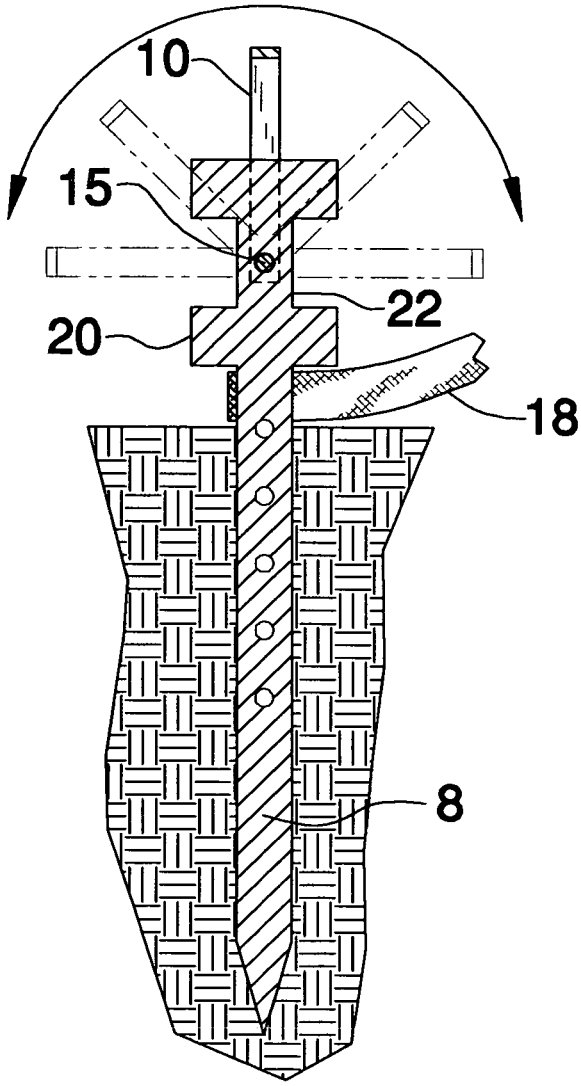
FIG. 4 is a cross sectional view of the device along line 4—4 according to FIG. 1.

This is a tent stake 8, which is comprised of a solid driving shaft with a tapered tip or point 4 at one end and a second cylindrical connecting piece with a first flat surface at the other end. FIGS. 1, 4 Between the tapered tip or point 4 and the first cylindrical flat piece 12 is a shaft member, which connects the first cylindrical connecting piece 12 to a second cylindrical connecting piece 20. FIG. 3 The two cylindrical (12, 20) connecting pieces are identical in shape and size and are positioned along the same axis as the tapered tip. FIG. 3

Figure 5:
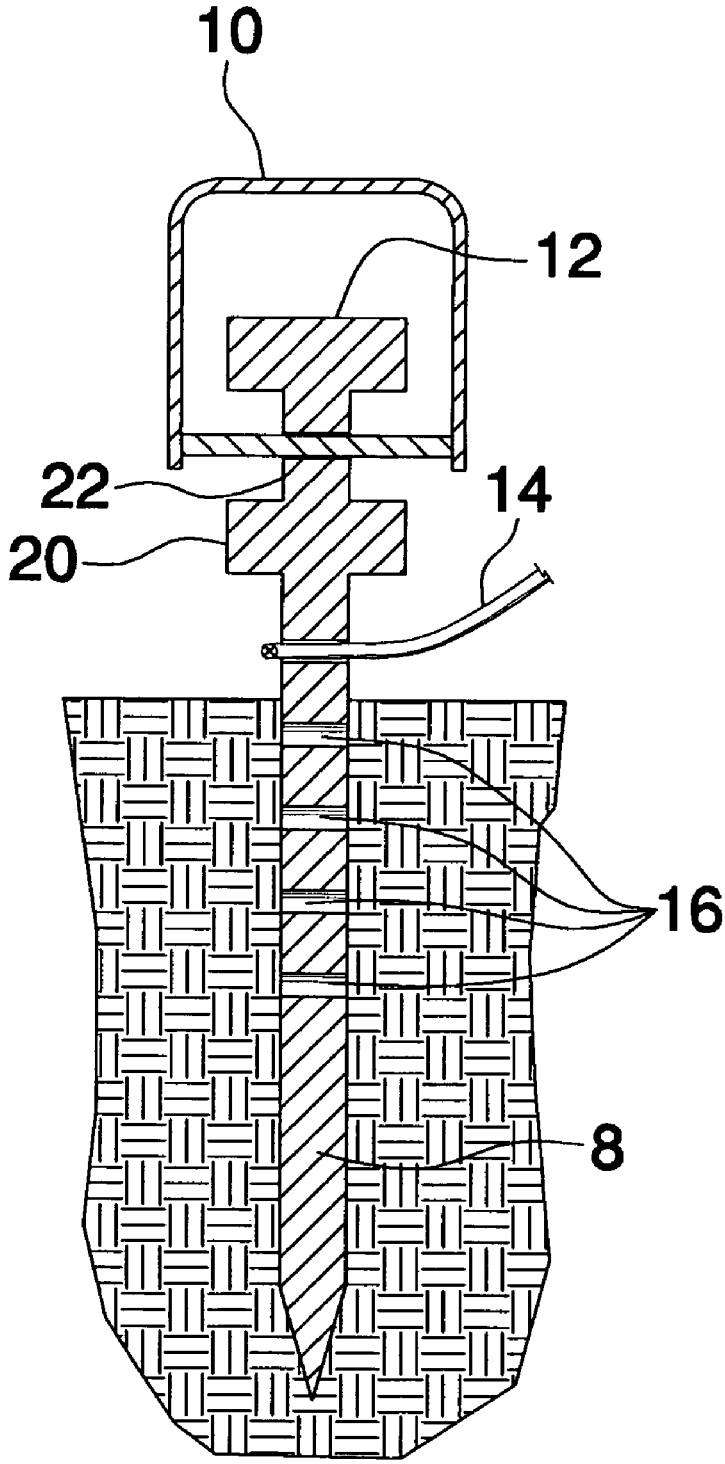
FIG. 5 is a cross sectional view of the device along line 5—5 on FIG. 2.

Between these cylindrical connecting pieces a shaft member 22 which allows for a handle 10 to be attached to the device in the middle of the shaft member 22. The handle 10 may be attached by inserting a hole into the shaft member 22 through which a handle 10 may be inserted or it may be manufactured as a single integral unit. The handle 10 is positioned such that it will rotate above the top of the flat top surface 12 but not interfere with the insertion of the device into the ground. FIGS. 3, 4, 5

Because of the weather and different ground conditions that are frequently experienced in camping the device should be constructed from durable non-corrosive material. Possible choices for the stake may include hard plastic, stainless steel or aluminum.

The purpose of the tapered tip 4 is to allow the device to be easily driven into the ground. FIG. 4

On one side of the first connecting piece 20 is the driving shaft with the tapered tip or point 4 and on the other side is the shaft member 22.

The device consists of an elongated shaft, which extends from the tapered tip or point 4 to the part of the device that remains above the ground. On one side of the device is the flat top surface 12 of the second connecting piece to pound the device into the ground.

The driving shaft 24 has a plurality of holes 16 for attaching a tie down string 14. FIG. 3 This can be used for a variety of tie down mechanisms such as a tent cover, as an example. FIG. 3

On the opposite side of the device is the handle 10 and a flat top surface 12 on the second connecting piece for pounding this device into the ground.

The handle 10 is attached to the shaft member and is allowed to swivel in order to pound the device into the ground without striking the handle by means of a pivot point 15. Figure The handle 10 would be placed to one side while the device is being pounded into the ground.

The handle 10 will be used to remove the stake from the ground without damaging the tent or the tent strap.

A variety of tie down strings 14 can be used to tie down various items with the tent. These tie down strings are different than the tent strap 18 and can include accessory items for a tent such as awnings or covers.

Ordinarily a tent is staked or secured in positioned by inserting a plurality of stakes around the perimeter of the tent. Loops, which form part of the tent and placed on the outside edge of the tent, are provided through which the device is placed. The string is inserted through the hole in the driving stake and the tent is secured. When the tent is taken down, the stakes are pulled from the ground and the tent is then free to be folded. Possible damage to the tent may occur when the tent stake is pulled through the loop in the tent. If the loop is ripped from the body of the tent it will not allow that part of the tent to be staked and makes the tent virtually unusable.

ALTERNATIVE EMBODIMENT

Although this device is to be used with a tent, it may also be used with other items, which need to be secured to the ground. This would include games such as volleyball and badminton to name a few. Both of these games require a net to be securely placed in the ground and this stake with its plurality of holes 14 located on the driving shaft 24 of the device. This would enable the net to be secured in place for the game to be played.

The appropriate strings for the net would be placed through the appropriate hole in the driving stake and the stake would then be inserted into the ground. The reverse process would occur in the event that the net needed to be removed.

The invention claimed is:

1. A tent stake for securing a tent comprising:

a. a driving shaft having a tapered point, b. a first connecting piece having a lower side and an upper side, said first connecting piece being a circular member having a predetermined diameter and a predetermined thickness, and said driving shaft being connected to said lower side of said first connecting piece;

c. a second connecting piece having a lower side and an upper side, said upper side having a flat top surface, and said second connecting piece being a circular member having a predetermined diameter and a predetermined thickness;

d. a shaft member, said shaft member being connected to said upper side of said first connecting piece and said lower side of said second connecting piece;

e. a handle having a cross member passed through an opening in said shaft member between the first and second connecting pieces;

wherein said handle is pivotally attached to said shaft member and is permitted to swivel cross over said second connecting piece and around a pivot point of said cross member;

wherein said tapered point is on said first end of said driving stake and said flat top surface is located on said second end of said driving stake;

wherein said driving shaft is driven into the ground by inserting the tapered point in the ground and pounding said driving stake on said flat top surface of said second connecting piece; and wherein, said driving shaft is provided with a plurality of holes for tie down a string of the tent.

2. The tent stake as described in claim 1, is constructed from metal.

3. The tent stake as described in claim 1, is constructed from hard plastic.

4. A method for securing a tent comprising steps of:

a. providing a tent stake as defined in claim 1;

b. providing a tent having tie down strings;

c. attaching the tie down string of the tent through a selected hole in the driving shaft of the tent stake;

e. inserting the tapered point of the tent skate into the ground; and f. pounding the flat top surface of the tent stake to drive the tent stake into the ground and secure the tent on the ground surface.

* * * * *